US007063266B2

(12) United States Patent
Goldenberg et al.

(10) Patent No.: US 7,063,266 B2
(45) **Date of Patent: *Jun. 20, 2006**

(54) PHOTOGRAPH ALBUM ACCESSORY INCLUDING AUDIO PLAYBACK DEVICE

(75) Inventors: Larry Goldenberg, 327 Central Park West #9E, New York, NY (US) 10025; Thomas Barham, Stamford, CT (US)

(73) Assignee: Larry Goldenberg, New York, NY (US)

( * ) Notice: Subject to any disclaimer, the term of this patent is extended or adjusted under 35 U.S.C. 154(b) by 108 days.

This patent is subject to a terminal disclaimer.

(21) Appl. No.: 10/638,617

(22) Filed: Aug. 11, 2003

(65) Prior Publication Data

US 2005/0023338 A1 Feb. 3, 2005

Related U.S. Application Data

(63) Continuation-in-part of application No. 10/420,647, filed on Apr. 22, 2003, now Pat. No. 6,892,951.

(51) Int. Cl.
*G06K 19/06* (2006.01)

(52) U.S. Cl. ..... 235/492

(58) Field of Classification Search ..... 235/492; 360/137; 150/139; 704/272; 40/717
See application file for complete search history.

(56) References Cited

U.S. PATENT DOCUMENTS

| | | | | |
|---|---|---|---|---|
| 3,741,565 A | | 6/1973 | Breitling et al. | 274/4 C |
| 4,105,057 A | | 8/1978 | Baumann et al. | 150/35 |
| 4,942,913 A | | 7/1990 | Musso | 150/138 |
| 5,313,235 A | | 5/1994 | Inoue et al. | 354/76 |
| 5,359,374 A | | 10/1994 | Schwartz | 354/76 |
| 5,365,686 A | | 11/1994 | Scott | 40/455 |
| 5,418,520 A | * | 5/1995 | Hirshberg | 340/568.7 |
| 5,431,207 A | | 7/1995 | Siegel | 150/139 |
| 5,484,292 A | | 1/1996 | McTaggart | 434/317 |
| 5,499,465 A | | 3/1996 | Manico | 40/152 |
| 5,504,836 A | | 4/1996 | Loudermilk | 395/2.81 |
| 5,520,544 A | * | 5/1996 | Manico et al. | 434/317 |
| 5,533,290 A | | 7/1996 | Lee et al. | 40/717 |
| 5,574,519 A | * | 11/1996 | Manico et al. | 396/429 |
| 5,775,398 A | * | 7/1998 | Siegel | 150/139 |
| 5,794,371 A | | 8/1998 | Camillery | 40/717 |
| 5,841,878 A | | 11/1998 | Arnold et al. | 381/124 |
| 5,956,682 A | | 9/1999 | Loudermilk | 704/272 |
| 5,979,097 A | | 11/1999 | Moore | 40/769 |
| 6,028,752 A | | 2/2000 | Chomette et al. | 360/137 |
| 6,041,532 A | | 3/2000 | Pollhaus et al. | 40/455 |
| 6,148,173 A | | 11/2000 | Bell | 434/309 |
| 6,185,851 B1 | | 2/2001 | Loudermilk et al. | 40/717 |
| 6,263,310 B1 | | 7/2001 | Loudermilk et al. | 704/272 |
| 6,377,926 B1 | | 4/2002 | Loudermilk | 704/272 |

(Continued)

*Primary Examiner*—Thien M. Le
*Assistant Examiner*—Lisa M. Caputo
(74) *Attorney, Agent, or Firm*—Gordon & Jackson, P.C.

(57) ABSTRACT

An accessory for a photograph album or scrapbook having a plurality of pages bound at a binding between front and back covers includes at least one device sleeve and a digital storage and playback device at least partially contained within a device sleeve. The accessory also includes a system for coupling each device sleeve to a page, the front cover, or the back cover of the album. The playback device has a memory capable of storing a plurality of digital audio files and at least one button adapted to initiate playback of a selected one of said files.

33 Claims, 7 Drawing Sheets

U.S. PATENT DOCUMENTS 6,381,573 B1 4/2002 Loudermilk ..... 704/272
6,396,472 B1 5/2002 Jacklin ..... 345/104
6,516,181 B1 2/2003 Kirwan ..... 434/317
6,892,951 B1 * 5/2005 Goldenberg et al. ..... 235/492

* cited by examiner

PHOTOGRAPH ALBUM ACCESSORY INCLUDING AUDIO PLAYBACK DEVICE

This application is a continuation-in-part of U.S. Ser. No. 10/420,647, filed Apr. 22, 2003, now U.S. Pat. No. 6,892, 951, which is hereby incorporated by reference herein in its entirety.

BACKGROUND OF THE INVENTION

1. Field of the Invention

This invention relates broadly to accessories for a photograph album. More particularly, this invention relates to an accessory which permits sound recordings to be associated with photographs in an album.

2. State of the Art

Wallet accessories for use with pre-existing wallets are described in U.S. Pat. No. 4,105,057 and U.S. Pat. No. 4,942,913. These devices are typically destined for "after market" applications where a retailer who sells conventional wallets also offers special inserts for the wallets. The wallet accessory shown in U.S. Pat. No. 4,105,057 is designed to provide extra storage space for carrying additional credit cards. The accessory may also be used to provide a credit card holder for wallets which are not so equipped. Although it would be possible to place photographs within these accessories, in order to view the photograph, the photographs would have to be removed from the receptacle.

U.S. Pat. No. 4,942,913 shows a "sub-wallet" for use with a main wallet. The sub-wallet carries important items which the wallet owner always needs, while the remainder of the wallet carries items that are,not absolutely necessary. If necessary, the owner can subsist on the sub-wallet alone, and does not require the contents of the main wallet. Although photographs could be placed in the wallet or the sub-wallet, it would not be possible to view more than one of these photos unless one were to remove them from the wallet or sub-wallet, thereby causing the photographs to become worn and mutilated over time.

Other types of wallets are described in U.S. Pat. Nos. 5,431,207 and 5,775,398. These patents disclose wallet accessories having compartmental arrangements for accommodating devices such as calculators, along with holders for accommodating sundries. None of the wallets or known accessories therefor are specifically adapted for use with audio devices in conjunction with photographs.

However, it is known to associate audio messages with photographs in an album. For example, U.S. Pat. No. 5,574,519 to Manico et al. teaches a system of a photograph album and an audio storage device attached thereto. Bar coded labels are associated with individual photographs in the album. Scanning a bar coded label with a scanning wand sends an infrared signal to the storage device to control playback of an audio file in the storage device associated with the label. In order to record an audio message for association with a photograph, the storage device must be put into a 'record' mode and the label associated with the photograph is scanned to access a designated message address in the storage device and the message is then input into the storage device via a microphone. As a result, the bar coded labels, scanning wand and playback device must be present to record a message. Thus, such a system is not highly portable, not well-adapted for intimate recordings, such as the spontaneous and cherished verbal interactions between a grandparent and a grandchild, and in practice essentially requires that the photograph album (with bar coded labels applied) be assembled with photographs before recordings associated with the photographs can be recorded.

SUMMARY OF THE INVENTION

It is therefore an object of the invention to provide a wallet accessory that is adapted to display photographs and to hold a portable digital playback device.

It is another object of the invention to provide a wallet accessory having a portable digital playback device that can store several files, e.g., audio and/or video messages, and reference each file to one of the several photographs stored in the accessory.

It is also an object of the invention to provide a photograph album which can easily be retrofit to playback sound recording associated with photographs therein.

It is an additional object of the invention to provide a digital recording and playback device for a photograph album which is highly portable.

It is a further object of the invention to provide a digital recording and playback device for a photograph album which is compact.

It is yet another object of the invention to provide a digital recording and playback device for a photograph album which can easily be provided with recordings and associated with photographs in an album even if such photographs are only placed in the photograph album after such recordings are made.

It is yet a further object of the invention to provide a digital recording and playback device which can be integrated with both permanently bound albums and albums adapted to receive additional photograph storage pages.

In accord with these objects, which will be discussed in detail below, a wallet accessory, according to a first embodiment of the invention, includes a plurality of photograph sleeves integrated with a dedicated sleeve for a digital playback device. In particular, the wallet accessory preferably comprises a panel having at one side the plurality of photograph sleeves coupled thereto, and at another side the dedicated sleeve for the playback device. The sleeve for the playback device preferably includes an opening within a face of the sleeve for permitting sound from a speaker of the device to be transmitted out of the dedicated sleeve.

The sleeves and the playback device are sized for placement within a wallet. To that end, an insert is coupled to a side of the panel and is adapted in size to be received in a pocket of the wallet to couple the panel, and thus the sleeves and the device to the wallet. In accord with one preferred embodiment of the invention, two inserts are coupled to the panel, one adapted for a horizontally-oriented wallet pocket and the other adapted for a vertically-oriented wallet pocket. The unnecessary insert is folded out of the way or removed.

According to a preferred aspect of the invention, the device preferably includes a plurality of buttons having individual indicia associated therewith, and a plurality of the photograph sleeves may be provided with indicia corresponding to the indicia associated with the buttons. As such, a photograph of a person in a photograph sleeve is associated with a recorded message by that person which is played back by pressing a corresponding button on the device.

According to another embodiment of the invention, the accessory is adapted for use in a photograph album. In such embodiment of the accessory, the photograph sleeves are preferably eliminated, while the accessory still includes a device sleeve for the playback device, a playback device therein, and preferably two inserts coupled to the device sleeve, one adapted for a horizontally-oriented oriented photograph pocket of such album and the other adapted for a vertically-oriented photograph pocket so as to couple the accessory to an album. The unnecessary insert is folded out of the way or removed. Alternatively, one or the other insert may be eliminated at manufacture. The device is coupled to the album by inserting the respective insert into a photograph pocket of the album and, as such, is particularly adapted for use in bound albums which are not adapted to receive additional pages. The messages stored in the device are associated with photographs according to the manner described above with respect to the wallet accessory, e.g., with labels corresponding to respective playback buttons on the device. In use, the sleeved device may be swung out relative to the page of the album so as to permit access to the playback buttons while viewing any page of the album. The recording associated with a particular photograph may be played by activation of an associated playback button.

According to a further embodiment of the invention, an insert page is provided for a photograph album designed to accept additional pages. According to one embodiment, the insert page is solely adapted for the storage and access of one or more of the above-described playback devices and includes coupling means for securing the insert page within the album. According to another embodiment, the insert page includes a combination of photograph pockets and at least one playback device pocket of a preferably relatively substantially smaller size, and coupling means for securing the insert page within the album. The recording and playback devices can easily be removed from the insert pages and transported, e.g., in a pants pocket, purse, or wallet to be available to capture recordings in a convenient manner and thereafter associated with photographs in an album in the manner described above.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
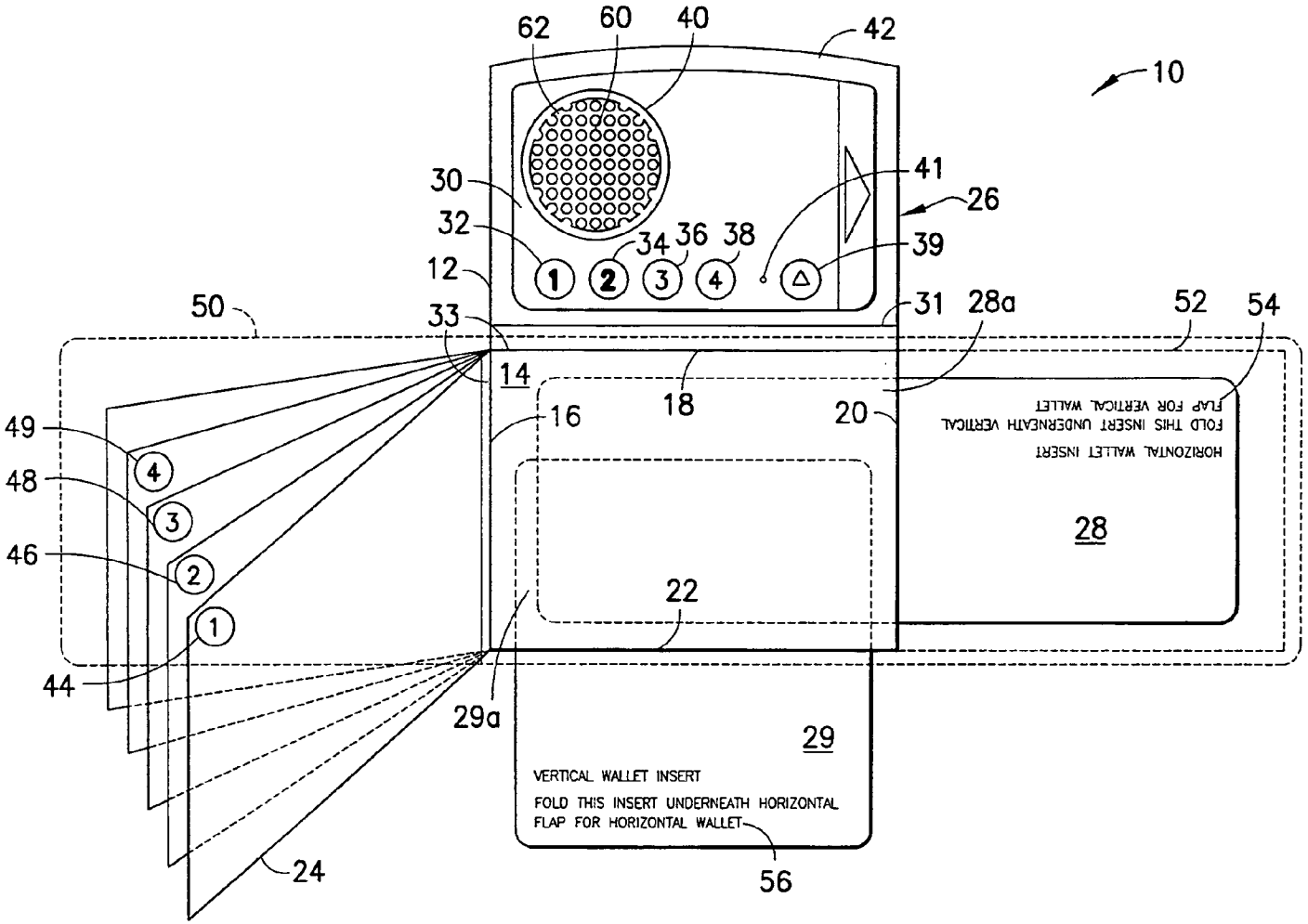
FIG. 1 is a schematic of a first embodiment of a wallet accessory according to the invention, including photograph sleeves and a digital playback device in another sleeve, with a wallet indicated by a set of broken lines.

Turning now to FIG. 1, a wallet accessory 10 is shown. The wallet accessory 10 includes a central panel 14 with sides 16, 18, 20, 22. The panel 14 may be a sleeve having a transparent front side so that a photograph may be placed within the panel and viewed by a user of the accessory. A plurality of photograph sleeves 24 are coupled to side 16 of the panel 14, a device sleeve 26 (for a digital audio device 30, described below) is coupled to side 18, and a first card-like insert 28 is coupled to side 20. A second insert 29 is preferably coupled to side 22 of the panel 14. Live hinges 33 or a flexible or bending material are preferably provided at the coupling of each of the elements to the panel 14. A digital playback device 30 is preferably removably retained within the device sleeve 26, although if desired, the device may be sealed in the sleeve 26 by a seal 31 (e.g., heat seal, bonding or stitching). The hinges 33 may be adapted in structure to permit limited movement of the photograph sleeves 24 and/or the device sleeve 26 relative to the panel 14 such that the sleeves 24, 26 when in a fully open configuration rest at an angle relative to the panel 14. Such angle may facilitate operation of the device 30 in sleeve 26 and viewing of photographs in sleeves 24.

The digital playback device 30 is generally the shape and size of a credit card (e.g., 2"×3"), although it may be slightly thicker (e.g., 3/32"–3/16"). The device 30 may include a power source (e.g., battery, not shown), a microphone 60 and an audio speaker 62, a memory (not shown) for storing digital files such as recorded messages, buttons 32, 34, 36, 38 operating playback functions and button 39 operating record functions, and an LED indicator 41. A credit card size audio recording and playback device is described in U.S. Pat. No. 6,028,752 to Chomette, which is hereby incorporated by reference herein in its entirety. As one of several distinctions from the Chomette device, device 30 preferably includes a plurality of playback buttons 32, 34, 36, 38 each having different indicia associated therewith. For example, button 32 has a '1' thereon, button 34 has a '2' thereon, button 36 has a '3' thereon, and button 38 has '4' thereon. Other indicia are shown on buttons 32*a*, 34*a*, 36*a*, 38*a* in FIG. 2.

The device 30, by way of example, may be operated to record an audio message for storage in memory by pressing the record button 39 in conjunction with any one of the playback button 32, 34, 36, 38. During recording, the LED indicator 41 lights up, and sound, e.g. voice, is directed by the user toward the microphone 60. Recording is terminated and the message is saved upon release of the record button 39 or when the memory allocated for that message is full, whichever occurs first. Each message preferably may be up to sixty seconds in length. The recorded message may thereafter be played back by pressing the corresponding playback button only.

The device sleeve 26 for the device 30 preferably includes opening 40 within a face 42 of the sleeve 26 (coincident with the speaker 62 and microphone 60 of the device) for purpose of permitting sound to enter a microphone 60 of the device and permitting sound from a speaker 62 of the device 30 to be transmitted out of the device sleeve 26. The other portions of the device 30 remain protected by the device sleeve 26, and the device is retained (from inadvertent loss) within the accessory.

The photograph sleeves 24 are sized to receive wallet-size format photographs (e.g., approximately 1"×1.5" to 3"×4" size). The photograph sleeves 24 preferably include respective indicia 44, 46, 48, 49 which correspond to the indicia associated with respective ones of the buttons 32, 34, 36, 38. That is, the indicia on an associated button and sleeve need not be same, but should clearly indicate that a sleeve corresponds with a particular one of the buttons. As such, a photograph of a person in a first photograph sleeve 44 is associated with a recorded message by that person which is played back by pressing a corresponding first button 32 on the device. Likewise, each of the other photograph sleeves with indicia may hold a photograph of a person who recorded a message played back by pressing a corresponding button.

Alternatively, the indicia 44, 46, 48, 49 for the photograph sleeves 24 may be separately provided, e.g., as a sheet of stickers, and the user can apply the stickers to the respective sleeves, as desired.

Figure 2:
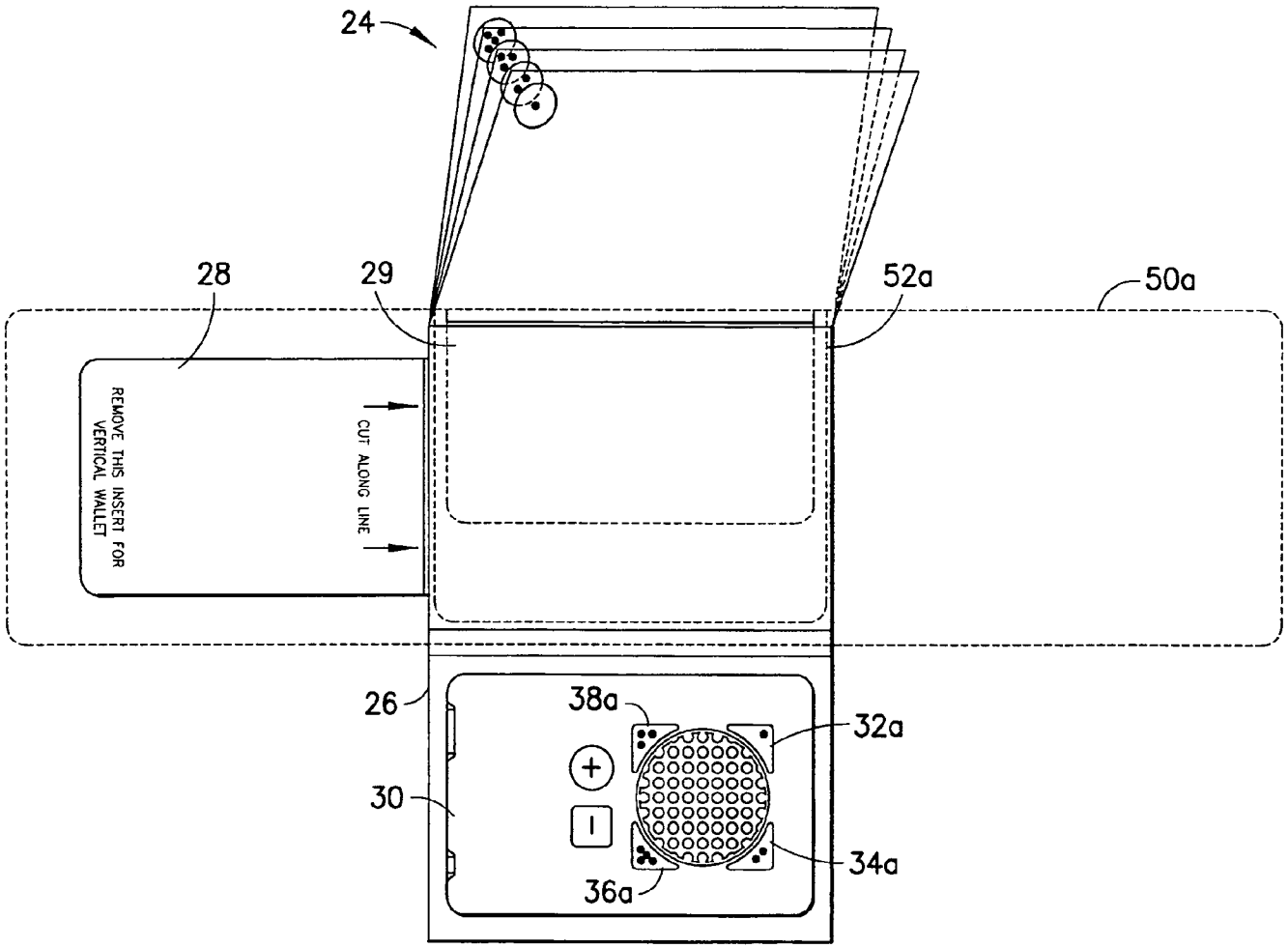
FIG. 2 is a schematic of a second embodiment of a wallet accessory according to the invention, with a wallet indicated by a set of broken lines.

The system 10 is sized for placement within a wallet 50. To that end, the first insert 28 is adapted in size and orientation to be longitudinally received in a lateral pocket 52 of a horizontal fold wallet. In addition, the second insert 29 is adapted in size and orientation to be transversely received in a vertical pocket of a vertical fold wallet. Depending on the type of wallet 50 with which the system 10 will be used, one of the first and second inserts 28, 29 will not be needed for coupling the insert 10 to the wallet. In FIG. 1, a wallet having a horizontal pocket 52 is shown, and thus the second insert 29 (adapted for a vertical pocket) is unnecessary. Referring to FIG. 2, a wallet 50*a* having a vertical pocket 52*a* is shown. The second insert 29 is folded back and inserted into the pocket 52*a*, and the first insert 28 is unnecessary. Referring back to FIG. 1, the unnecessary insert can be removed (cut or torn away) or folded behind out of the way, as indicated by 28*a* and 29*a* (broken lines), by the user prior to attaching the system 10 to the wallet 50. Instructions 54, 56 may be provided on the inserts 28, 29 indicating the removal or folding of the inserts based upon wallet type.

Figure 3:
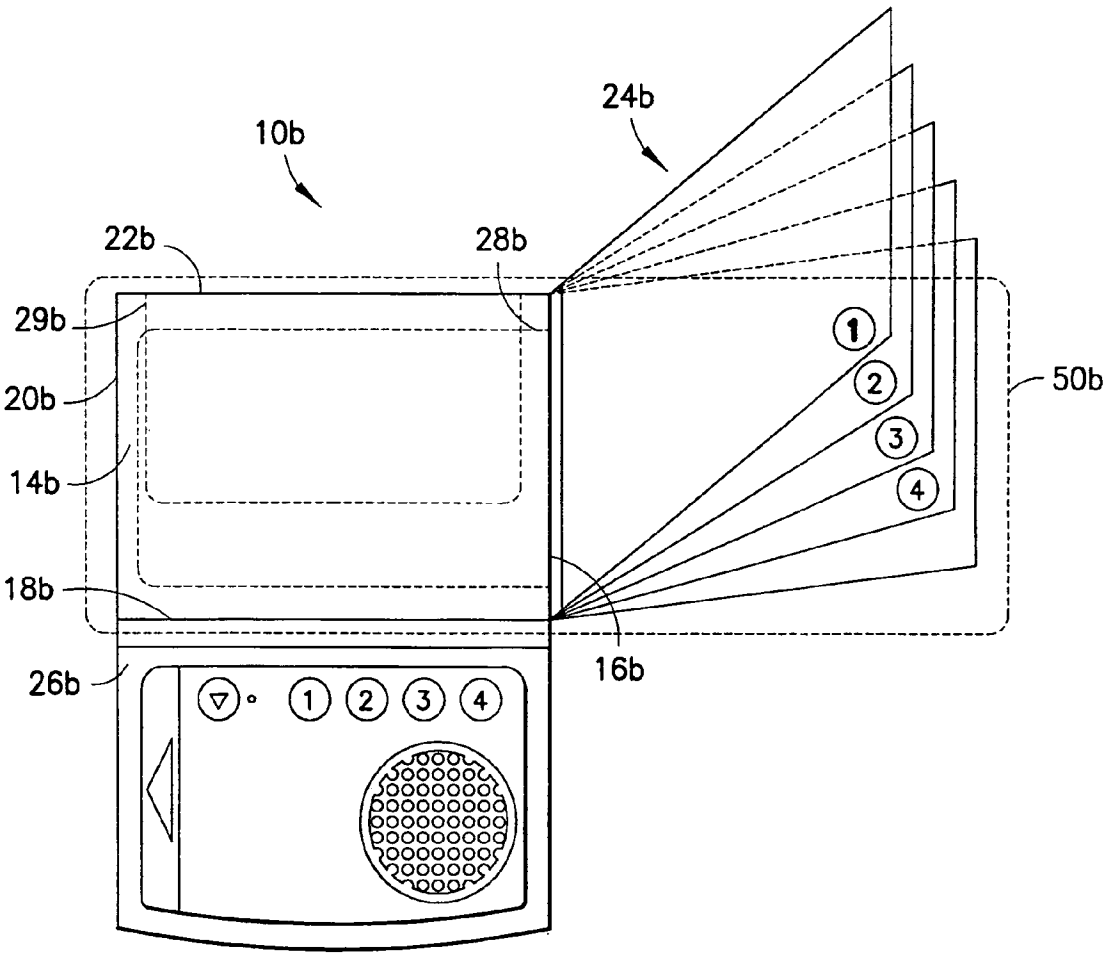
FIG. 3 is a schematic of a third embodiment of a wallet accessory according to the invention, with a wallet indicated by a set of broken lines.

Turning now to FIG. 3 another embodiment of the accessory 10*b* is shown. The accessory 10*b* includes a panel 14*b* having a plurality of photograph sleeves 24*b* coupled to side 16*b*, a horizontal insert 28*b* also coupled to side 16*b*, a device sleeve 26*b* coupled to side 18*b*, and a vertical insert 29*b* coupled to side 22*b*. The horizontal and vertical inserts 28*b*, 29*b* underlie the panel 14*b*. In FIG. 3, the horizontal insert 28*b* is shown longitudinally inserted into a pocket of bi-fold wallet 50*b*. When the accessory 10*b* is closed, the device sleeve 26*b* is folded over the panel 14*b* and the photograph sleeves 24*b* are folded over the device sleeve 26*b* such that every element of the accessory (the panel 14*b*, photograph sleeves 24*b*, device sleeve 26*b*, and horizontal and vertical inserts 28*b*, 29*b*) overlie (underlie) one another.

The photograph sleeves 24 and device sleeve 26 are preferably made from acrylic, polyvinyl or another transparent plastic and are preferably flexible so as to prevent cracking or other damage to the sleeves when the system 10 is placed within the wallet.

With the wallet accessory 10 of the invention, it will be appreciated that the user of the wallet will have the opportunity to look at pictures contained in a photograph sleeve 24 and listen to a voice recording associated with that photograph by manipulating the audio device 30 in the device sleeve 26.

Figure 4:
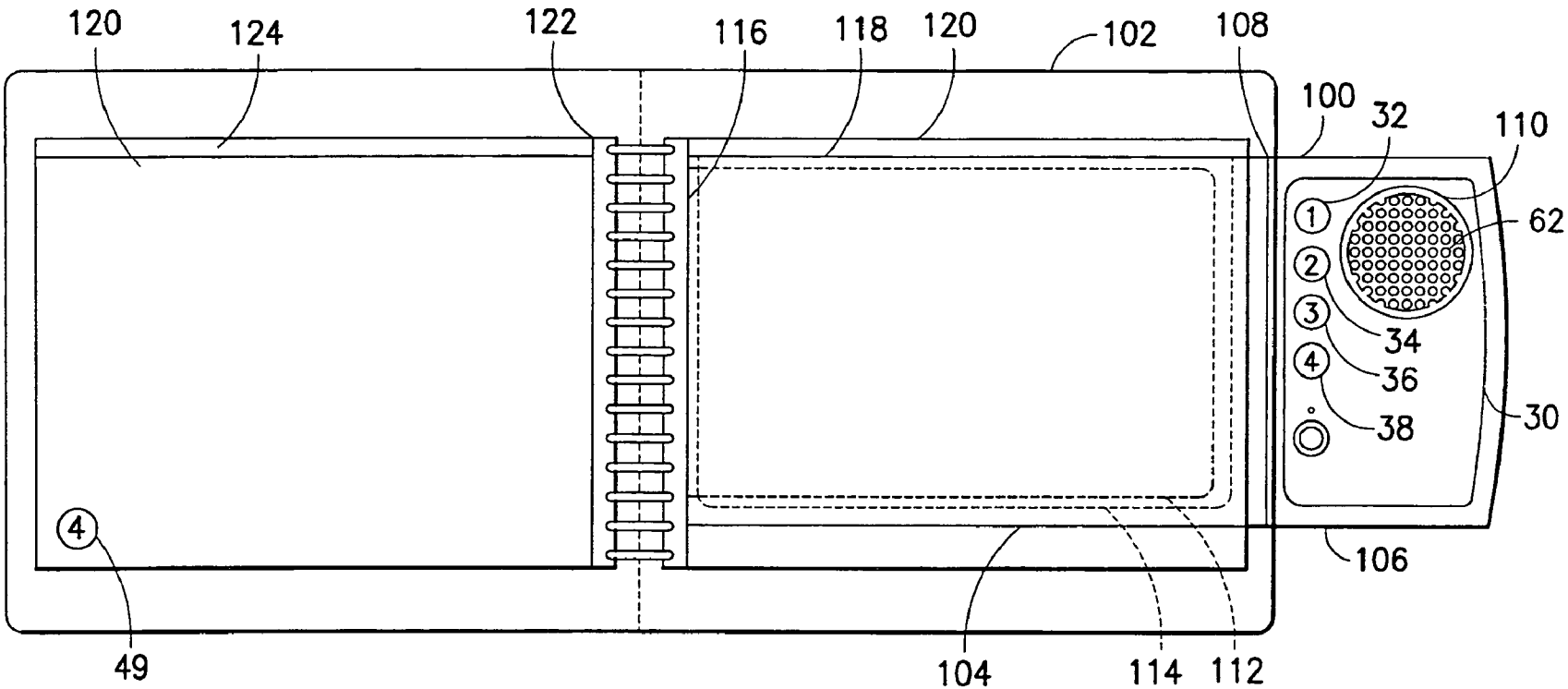
FIG. 4 is a schematic view of a photograph album and an accessory therefor in accord with an embodiment of the invention.

Turning now to FIG. 4, according to another embodiment of the invention, an accessory 100 similar to the wallet accessory 10 described above, is adapted for use in a photograph album 102. The accessory 100 includes a panel 104, a device sleeve 106 coupled to the panel 104 preferably with a live hinge 108, and a playback device 30 within the device sleeve 106. The panel 104 may be a single layer, a photograph sleeve itself (as described with respect to the wallet accessory 10), or any other suitable construction. The device sleeve 106 preferably has an opening 110 coincident with the speaker 62 of the playback device 30. The accessory 100 also preferably includes two inserts 112, 114 which preferably underlie the panel 104. Insert 112 is coupled to an edge 116 of the panel 104 opposite the live hinge 108 and insert 114 is coupled to an upper edge 118 of the panel 104 between edge 116 and the live hinge 108.

The photograph storage sleeves 120 of the album 102 include either a vertical slit 122 or a horizontal slit 124 through which photographs can be inserted into the storage sleeves 120. Where such slits are vertical, insert 114 is folded out of the way or removed, and insert 112 is slid horizontally through the slit 122 and into the photograph pocket 120 of one of the pages of the album to thereby couple the accessory 100 to the album 102. Where such slits are horizontal, insert 112 is folded out of the way or removed, and insert 114 is slid vertically through the slit 124 and into the photograph pocket 120 of one of the pages of the album to thereby couple the accessory 100 to the album 102. As the accessory 100 couples within a photograph pocket of the album, the accessory is particularly well-suited for use in bound albums.

The audio messages stored in the device 30 are associated with photographs of the album 102 according to the manner described above with, e.g., labels 49 corresponding to respective playback buttons 32, 34, 36, 38 on the device 30.

In use, the device sleeve 106 may be swung out relative to the panel 104, and thus relative the page 120 of the album 102 to which the panel is attached (to the position shown in FIG. 4) so as to permit access to the playback buttons 32, 34, 36, 38 while viewing any page 120 of the album 102. The recording associated with a particular labeled photograph may be played by activation of the associated playback button. When the album 102 is ready to be put away, the device sleeve 106 is folded on the live hinge 108 to overlie the panel 104, and the live hinge 108 defines the outer edge of the accessory 100. In this manner, the footprint of the accessory is minimized such that the accessory 100 preferably does not extend outside the boundary defined by the covers of the album.

Figure 5:
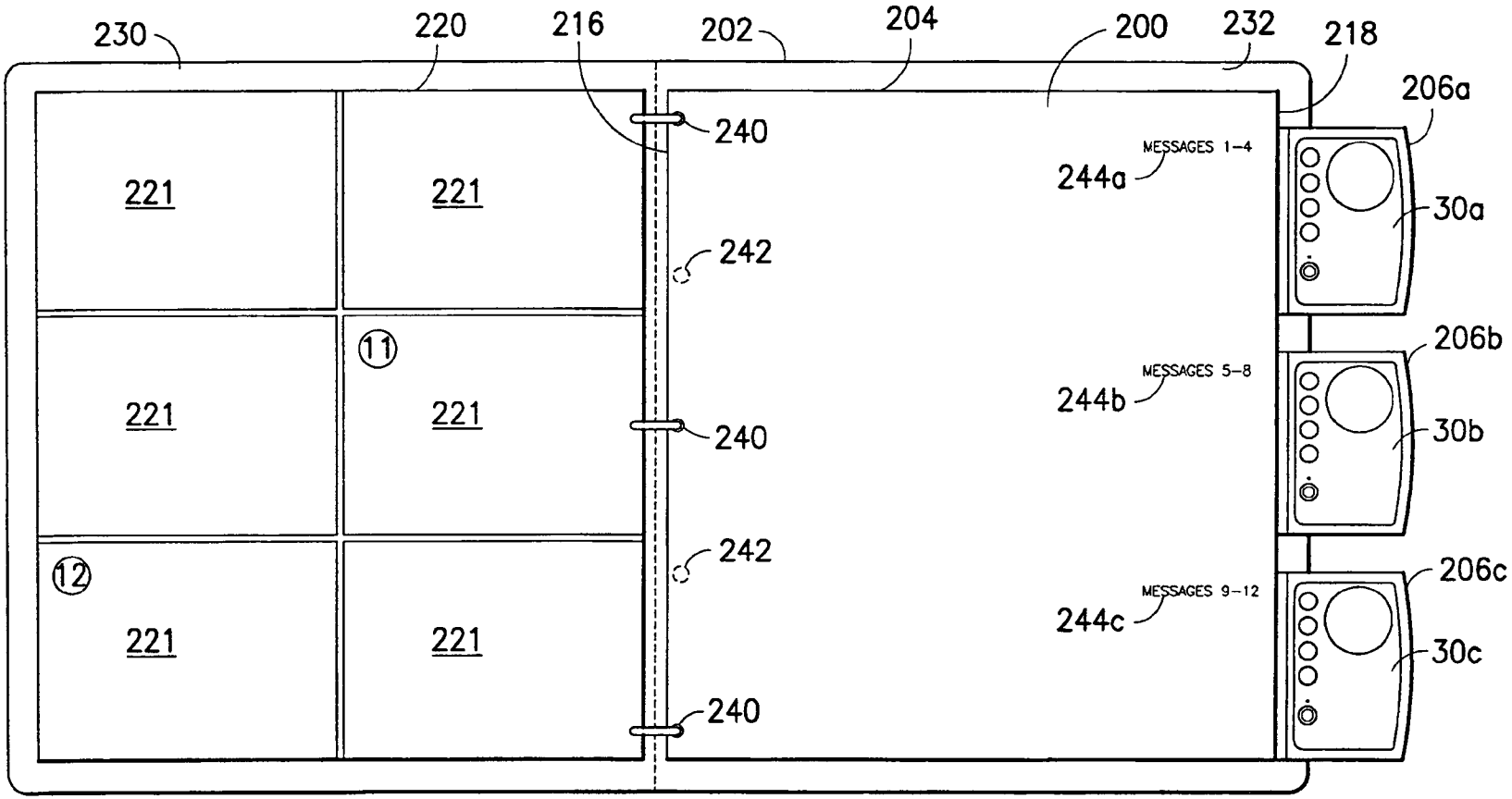
FIG. 5 is a schematic view of a photograph album and an insert page therefor in accord with another embodiment of the invention.

Turning now to FIG. 5, according to a further embodiment of the invention, an insert page 200 is provided for a photograph album 202. The insert page 200 includes a plastic or cardboard panel 204 which is preferably substantially the same size as the photograph storage pages 220 of the album 202. Such storage pages 220 include pockets 221 which receive photographs. The insert page 200 includes an inner vertical edge portion 216 which preferably includes one or more sets of holes 240, 242 which permit the page 200 to be inserted into a variety albums having an openable binder, such as the three-ring binder-type album 202 shown. Alternatively, for those albums which do not readily accept new pages, the panel 204 may be provided with adhesive or some other means by which it may be coupled directly to one of the pages 220, or the front or back covers 230, 232 of the album 202. One or more device sleeves 206*a*, 206*b*, 206*c*, each of which may contain an audio playback device 30*a*, 30*b*, 30*c*, are preferably hingedly coupled to an edge of the panel 204, and most preferably the outer vertical edge 218 thereof so that the device sleeves may be folded out for access to the device buttons, or folded in to limit the profile of the album. The panel 204 preferably includes indicia 244*a*, 244*b*, 244*c* which associates stored messages on a respective device 30*a*, 30*b*, 30*c* in a device sleeve 206*a*,

206*b*, 206*c* adjacent the indicia with photographs identified by corresponding indicia throughout the album.

Figure 6:
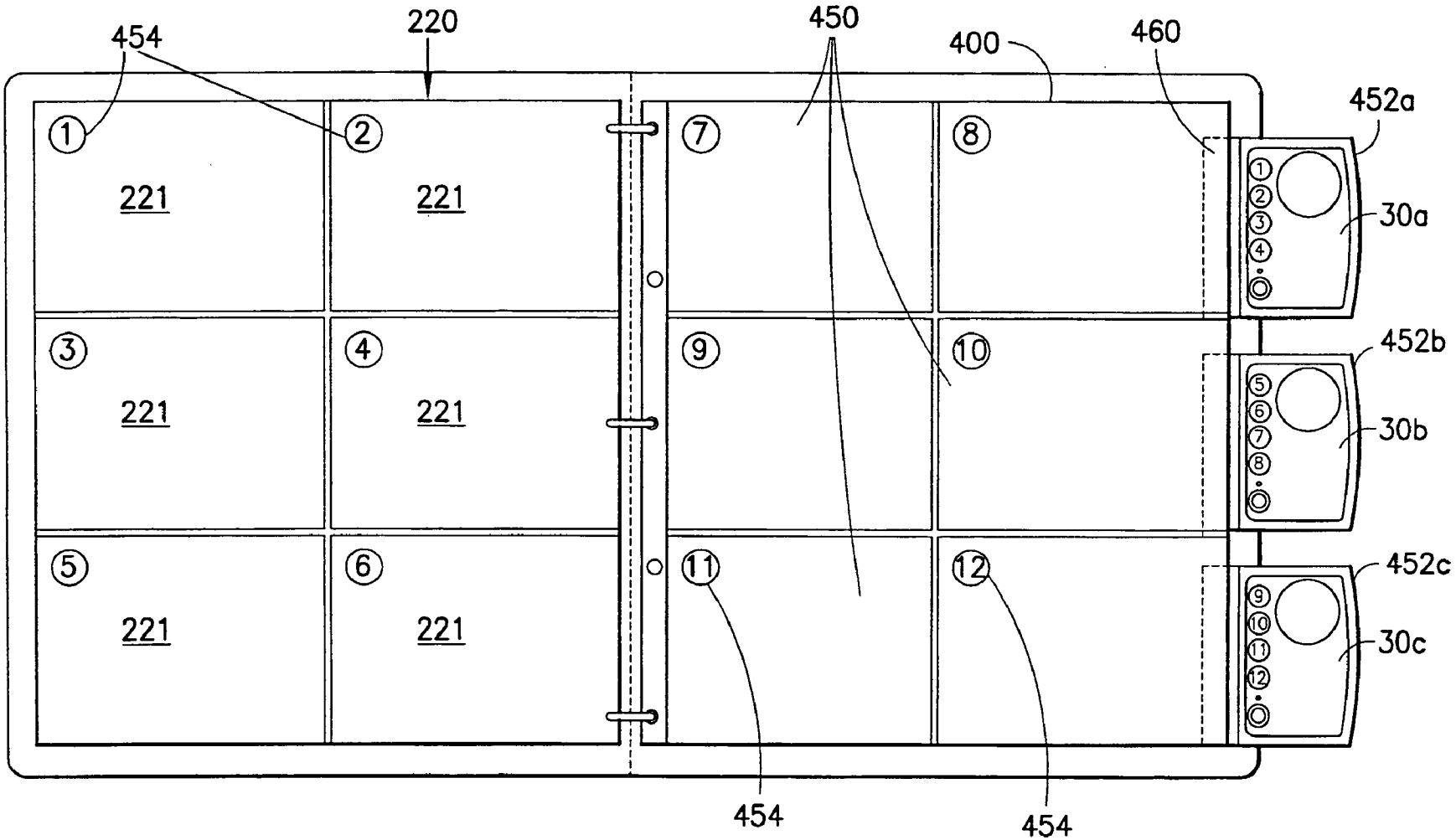
FIG. 6 is a schematic view of a photograph album and insert page therefor in accord with a further embodiment of the invention.

Turning now to FIG. 6, according to another embodiment of an insert page, the insert page 400 includes a plurality of photograph pockets 450 substantially similar to pockets 221 on conventional storage page 220, as well as one or more device sleeves 452*a*, 452*b*, 452*c*, each of which may contain a device 30*a*, 30*b*, 30*c*. The device sleeves 452*a*, 452*b*, 452*c* are preferably coupled to the insert page as discussed above with respect to the embodiment of FIG. 5, and are similarly utilized. Indicia 454 may be provided on pockets 221 and 450 to associate audio files on the devices with photographs in the album.

Still referring to FIG. 6, alternatively, the panel 400 may be eliminated, and the device sleeves, e.g. 452*a*, may include a strip 460 (shown in broken lines) provided with adhesive or other means by which to couple the sleeve to the edge of a conventional photograph storage page 220. Such readily permits device 30 to be coupled to a photograph album which does not readily accept additional pages.

Figure 7:
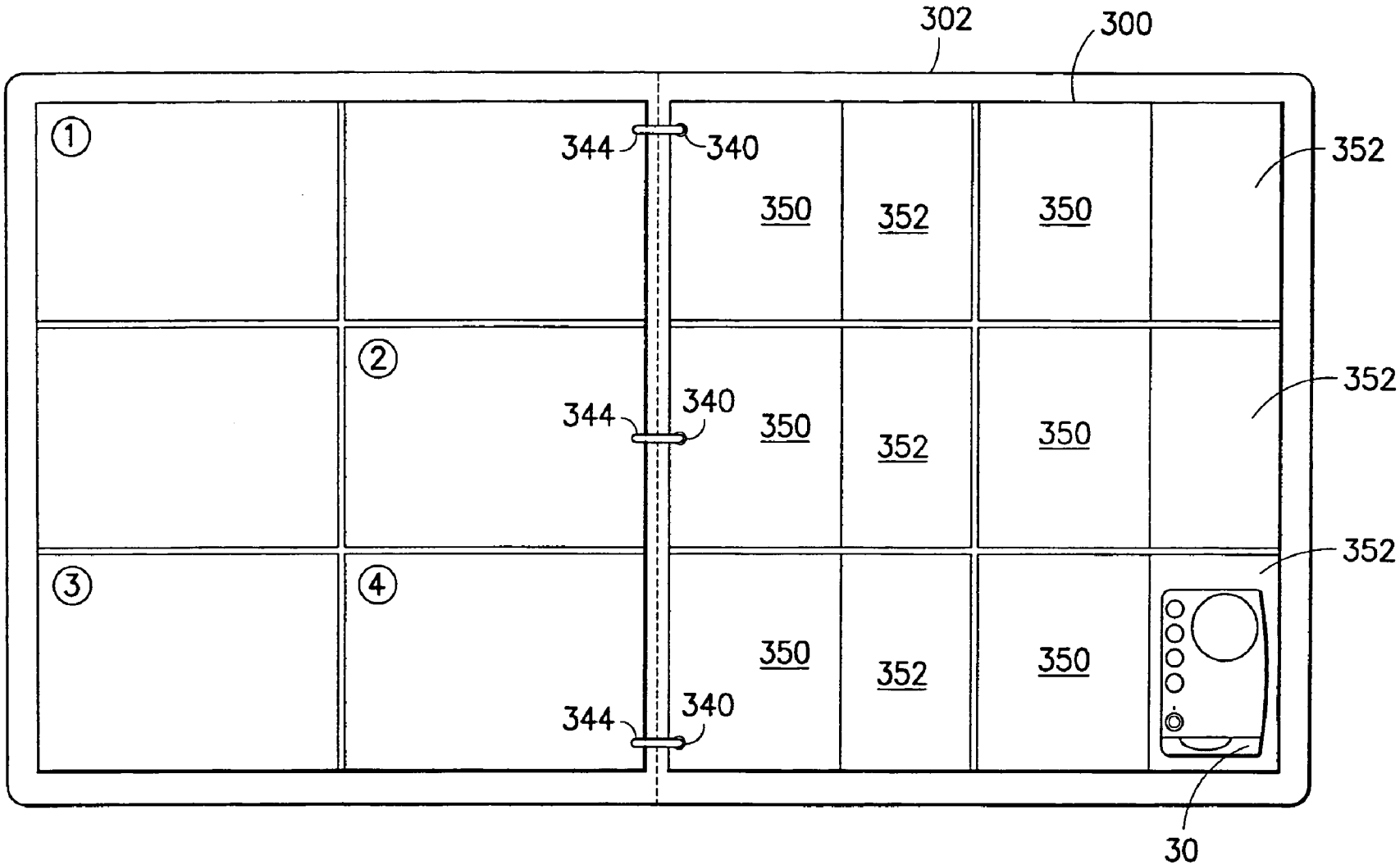
FIG. 7 is a schematic view of a photograph album and an insert page therefor in accord with yet another embodiment of the invention.

Referring now to FIG. 7, according to a further embodiment of an insert page, the insert page 300 includes a combination of photograph pockets 350 and at least one playback device pocket 352 preferably of a relatively smaller size. Multiple device pockets 352 are preferably provided, each overlying a photograph pocket 350, as shown, to permit the location of the device with respect to the page 300 to be varied. A playback device 30 is provided in at least one of the device pockets 352. The insert page 300 includes holes 340 or other coupling means for coupling to binder rings 344 of the album 302 after any particular page of the album. Several insert pages 300 can be provided in a single album, with each insert page preferably directly following a group of photographs to which sound recordings on the device are related. As such, insert page 300 is ideally suited for, though not limited to, associating recorded messages with annual or periodic events, e.g., birthday parties, holidays, vacations, school events, sporting events, etc., where it is desired to construct a photographic and auditory record of the annually or otherwise recurring events, with the photographic and auditory record together being in generally chronological order.

It is preferable that when a plurality of such insert pages 300 and playback devices 30 are to be used within an album, and each insert page includes multiple device pockets 352, the playback devices 30, to the extent possible, should be offset in location on successive pages to permit the pages to lay together as flat as possible. By way of example, insert page 300 includes six device pockets 352 which each overlie photo pockets 350. On a first insert page, the device pocket in the upper left corner can be provided with a playback device, while the photo pockets which do not underlie that device pocket can be provided with photos. In successive pages, the device is provided in device pockets at different locations, while the remaining photo pockets are provided with photographs. Most preferably, the successive locations of the device is ordered, e.g., with a second insert page including the device in an upper right device pocket, a third insert page including the device in a middle left device pocket, a fourth insert page including the device in a middle right device pocket, a fifth insert page including the device in a lower left device pocket, and a sixth insert page including the device in a lower right device pocket (as shown in FIG. 7). Similarly, where an insert page includes a single device pocket, the location of that device pocket is preferably offset on successive pages to permit the pages to lay together as flat as possible.

In each of the above embodiments, the recording and playback devices 30 can easily be transported in a pants pocket, purse, or wallet, i.e., without the photograph album, to capture recordings in a convenient manner and thereafter associate those recordings with photographs in an album in the manner described above.

There have been described and illustrated herein embodiments of accessories for wallets and photograph albums which associate photographs in a plurality of photograph sleeves with recordings on an audio playback device. While particular embodiments of the invention have been described, it is not intended that the invention be limited thereto, as it is intended that the invention be as broad in scope as the art will allow and that the specification be read likewise. Thus, while an audio device having recording and playback capabilities is described, the audio device might having playback capability only, and audio storage may be obtained from a download via a data port (not shown). In addition, the device may additionally or alternatively have video capability for playback of video files, where the video files are placed in device memory by a recording system of the device and/or via download. Also, while the wallet and album accessories are shown as having both horizontal and vertical inserts, it will be appreciated that only one insert is required. Moreover, while it is envisioned that the above invention will primarily be used to associate audio files with photographs, it is recognized that in accord with the invention audio files may be associated with other pictographic articles such as trading cards, postcards, and memorabilia. Furthermore, while the album inserts and accessories have primarily been described with respect to photograph albums, it is appreciated that such may be used with other albums, such as scrapbook albums. It will therefore be appreciated by those skilled in the art that yet other modifications could be made to the provided invention without deviating from its spirit and scope as claimed.

What is claimed is:

1. An accessory for an album having a plurality of pages with pockets in which to receive pictographic articles such as photographs, said accessory comprising:

a) a panel;

b) a device sleeve coupled to said panel;

c) a digital storage and playback device at least partially contained within said device sleeve, said device having at least one memory capable of storing a plurality of digital audio files and at least one button adapted to initiate playback of a selected one of said files; and d) at least one insert coupled to said panel and extending in at least one of a horizontal and vertical direction from said panel.

2. An accessory according to claim 1, wherein:

said device is removable from and replaceable into said device sleeve.

3. An accessory according to claim 1, wherein: said device has dimensions generally corresponding to a credit card.

4. An accessory according to claim 1, wherein: said playback device includes a speaker, and said device sleeve includes an opening coincident with said speaker.

5. An accessory according to claim 4, wherein:

said playback device includes recording functionality and a microphone, and said device sleeve includes an opening coincident with said microphone.

6. An accessory according to claim 1, wherein:

said at least one insert is a first insert extending horizontally from said panel and a second insert extending vertically from said insert.

7. An accessory according to claim 1, further comprising:

a set of labels each including indicia thereon and an adhesive for adhesion to the outside of pockets of the album, and wherein said at least one button of said playback device includes a plurality of playback buttons each having respective indicia associated therewith, and said indicia on said labels associate each label in said set with a corresponding playback button.

8. An accessory according to claim 1, wherein:

said at least one insert at least partially underlies said panel.

9. An accessory according to claim 1, wherein:

said device sleeve is coupled to said panel with a live hinge.

10. An accessory according to claim 1, wherein:

said at least one insert is for coupling the device sleeve within a pocket of a page of the album.

11. An accessory for an album having a plurality of pages bound at a binding between front and back covers, comprising:

a) at least one device sleeve;

b) a digital storage and playback device at least partially contained within at least one of said at least one device sleeve, said device having at least one memory capable of storing a plurality of digital audio files and at least one button adapted to initiate playback of a selected one of said files; and c) coupling means for coupling each said at least one device sleeve to one of a page, the front cover and the back cover of the album.

12. An accessory according to claim 11, wherein:

said playback device includes a speaker, and each said device sleeve includes an opening located to be coincident with said speaker when said playback device is at least partially contained in said device sleeve.

13. An accessory according to claim 11, wherein:

said at least one device sleeve is transparent.

14. An accessory according to claim 11, wherein:

said coupling means includes an adhesive coupled to said device sleeve.

15. An accessory according to claim 11, wherein:

said coupling means includes a panel which is directly couplable to one of the binding, front cover, and back cover of the album.

16. An accessory according to claim 15, wherein:

said panel is sized substantially the same size as the size of a page of the album.

17. An accessory according to claim 15, further comprising:

a plurality of photograph storage pockets coupled to said panel.

18. An accessory according to claim 15, wherein:

said at least one device storage pocket is fixed relative to said panel.

19. An accessory according to claim 15, wherein:

said at least one device storage pocket overlies one of said photograph storage pockets.

20. An accessory according to claim 15, wherein:

wherein said panel includes an edge portion with a plurality of holes.

21. An accessory according to claim 15, wherein:

said panel includes an adhesive.

22. An accessory according to claim 11, wherein:

said at least one device sleeve is attached to said coupling means by a hinge.

23. An accessory according to claim 22, wherein:

said hinge is a live hinge.

24. An accessory according to claim 11, further comprising:

a set of indicia which associates photographs stored in the pages of the album with audio files stored on said at least one playback device.

25. An album for storing pictographic articles, comprising:

a) front and back covers;

b) a plurality of pages coupled by a binding and situated between said front and back covers; and c) a digital storage and playback device coupled to at least one of said pages.

26. An album according to claim 25, wherein:

at least one of said pages is provided with a device storage sleeve, and said playback device is at least partially contained by said device storage sleeve.

27. An album according to claim 26, wherein:

a playback device is coupled to each of said plurality of pages, and said playback device of each said page is in an offset location relative to said playback device of another page.

28. An album according to claim 26, wherein:

said at least one of said pages is also provided with photograph storage sleeves.

29. An album according to claim 28, wherein:

said at least one device storage pocket overlies a photograph storage pocket of a same page.

30. An album according to claim 28, further comprising:

a set of indicia which associates pictographic articles photographs stored within said album with audio files stored on said playback device.

31. An album according to claim 26, wherein:

said device storage sleeve is movable relative to said page.

32. An album according to claim 31, wherein:

said device storage sleeve is coupled to said with a live hinge.

33. An album according to claim 26, wherein:

said device storage sleeve is fixed relative to said page.

* * * * *